US011000177B2

(12) United States Patent
Mason et al.

(10) Patent No.: US 11,000,177 B2
(45) Date of Patent: May 11, 2021

(54) WASH SYSTEM FOR WASHING APPLIANCE

(71) Applicant: Fisher & Paykel Appliances Limited, Auckland (NZ)

(72) Inventors: Wayne Andrew Mason, Dunedin (NZ); Paul Christiaans, Mosgiel (NZ); Robert Effingham Lawrence, Dunedin (NZ)

(73) Assignee: FISHER & PAYKEL APPLIANCES LIMITED

( * ) Notice: Subject to any disclaimer, the term of this patent is extended or adjusted under 35 U.S.C. 154(b) by 598 days.

(21) Appl. No.: 15/550,659

(22) PCT Filed: Feb. 15, 2016

(86) PCT No.: PCT/NZ2016/050017
§ 371 (c)(1),
(2) Date: Aug. 11, 2017

(87) PCT Pub. No.: WO2016/130027
PCT Pub. Date: Aug. 18, 2016

(65) Prior Publication Data

US 2018/0035864 A1 Feb. 8, 2018

(30) Foreign Application Priority Data

Feb. 13, 2015 (NZ) ..... 704973

(51) Int. Cl.
*A47L 15/42* (2006.01)
*A47L 15/22* (2006.01)
(Continued)

(52) U.S. Cl.
CPC ..... *A47L 15/4285* (2013.01); *A47L 15/0084* (2013.01); *A47L 15/0089* (2013.01);
(Continued)

(58) Field of Classification Search
CPC .. A47L 15/4204; A47L 15/22; A47L 15/4225; A47L 15/44; A47L 15/0084;
(Continued)

(56) References Cited

U.S. PATENT DOCUMENTS 5,470,142 A * 11/1995 Sargeant ..... A47L 15/0084 312/258
5,837,151 A 11/1998 Jozwiak
(Continued)

FOREIGN PATENT DOCUMENTS

EP 1 723 888 A1 11/2006
WO 93/12706 A1 7/1993
WO 98/33426 A1 8/1998

*Primary Examiner* — Benjamin L Osterhout
(74) *Attorney, Agent, or Firm* — Clark Hill PLC; James R. Foley

(57) ABSTRACT

A washing machine such as a dishwashing machine, preferably of the drawer-style or table-top style, or a laundry washing machine, the washing machine having at least one low-height wash liquid conduit connecting the outlet of a sump region of a washing tub to a wash pump. The at least one low-height conduit having a transverse cross-section that is substantially oblong. In one aspect, the surface of a heating unit forms a surface of a low-height conduit. In another aspect, the sump is provided with multiple outlets. In another aspect, a cover plate is provided for covering a section of a washing tub base and the at least one low-height conduit is formed between the base of the washing tub and the cover plate by a combination thereof. In another aspect, a pump cap component is located in the washing tub, the pump cap component having upper and lower spaced walls and at least one connecting wall between the upper and lower spaced walls, the connecting wall(s) arranged so as to form a closed shape when viewed from above, the closed shape including a wash pump housing volume for an impeller of the wash pump.

20 Claims, 10 Drawing Sheets

(51) Int. Cl.

| | |
|---|---|
| ***A47L 15/44*** | (2006.01) |
| ***A47L 15/00*** | (2006.01) |
| *D06F 39/08* | (2006.01) |
| *D06F 39/04* | (2006.01) |
| *D06F 39/10* | (2006.01) |
| *D06F 37/26* | (2006.01) |

(52) U.S. Cl.
CPC ..... *A47L 15/22* (2013.01); *A47L 15/4204* (2013.01); *A47L 15/4206* (2013.01); *A47L 15/4219* (2013.01); *A47L 15/4225* (2013.01); *A47L 15/4257* (2013.01); *A47L 15/4274* (2013.01); *A47L 15/4287* (2013.01); *A47L 15/4293* (2013.01); *A47L 15/44* (2013.01); *D06F 37/26* (2013.01); *D06F 39/04* (2013.01); *D06F 39/08* (2013.01); *D06F 39/10* (2013.01)

(58) Field of Classification Search
CPC ..... A47L 15/4285; A47L 15/4287; A47L 15/4274; A47L 15/4219; A47L 15/0089; A47L 15/4206; A47L 15/4293; A47L 15/4257; D06F 39/04; D06F 39/10; D06F 39/08; D06F 37/26
See application file for complete search history.

(56) References Cited

U.S. PATENT DOCUMENTS

| | | | | |
|---|---|---|---|---|
| 6,418,943 | B1 | 7/2002 | Miller | |
| 6,698,438 | B2 | 3/2004 | Hegeman et al. | |
| 2004/0003830 | A1* | 1/2004 | Elick | A47L 15/4225 134/10 |
| 2005/0120533 | A1 | 6/2005 | Yoon et al. | |
| 2006/0174916 | A1 | 8/2006 | Hedstrom et al. | |
| 2007/0068562 | A1* | 3/2007 | Wetzel | A47L 15/4221 134/56 D |
| 2007/0095369 | A1* | 5/2007 | Wetzel | A47L 15/48 134/56 D |
| 2007/0246089 | A1* | 10/2007 | Welch | A47L 15/4225 134/56 D |
| 2008/0011335 | A1 | 1/2008 | Kim et al. | |
| 2009/0007942 | A1* | 1/2009 | Park | A47L 15/0002 134/107 |
| 2010/0139698 | A1* | 6/2010 | Gnadinger | A47L 15/0052 134/25.2 |
| 2010/0139719 | A1* | 6/2010 | Gnadinger | A47L 15/4282 134/56 D |
| 2012/0048313 | A1* | 3/2012 | Armstrong | F16K 11/052 134/56 D |
| 2012/0118330 | A1* | 5/2012 | Tuller | A47L 15/0084 134/25.2 |

* cited by examiner

WASH SYSTEM FOR WASHING APPLIANCE

RELATED/PRIORITY APPLICATION

This application is a National Phase filing regarding International Application No. PCT/NZ2016/050017, filed on Feb. 15, 2016, which relies upon NZ Application No. 704973, filed on Feb. 13, 2015 for priority.

TECHNICAL FIELD

The present invention relates to washing appliances and more particularly, though not solely, to wash systems within washing appliances that recirculate wash liquid during a washing cycle. In particular, the wash system of the invention is suitable for use in a dishwasher or clothes washing machine.

BACKGROUND ART

The wash system of our currently available Dishdrawer™ drawer-type dishwasher, as disclosed for example in W09312706A or WO9833426A (the disclosures of which are hereby incorporated by reference), includes a wash pump that is centrally located in the base of the wash tub. The wash pump draws wash liquid in radially beneath a large stainless steel "coarse" filter plate covering much of the base of the wash tub. The coarse filter plate has an annular region of perforations near its outer edge through which recirculating wash liquid passes to the underside of the coarse filter plate, then radially inwardly toward the wash pump over an annular heating plate surrounding the wash pump. The heated wash liquid then flows into the wash pump inlet and then upwardly through a central aperture in the coarse filter plate out of the wash pump via an impeller mounted within a spray arm. Soil or other particles too large to pass through the perforations in the coarse filter plate are washed into a drain sump located beneath an opening in the coarse filter plate and which is provided with a removable "fine" mesh filter strainer for capturing the large particles. The entire wash system is designed so that vertical height utilisation is minimised—an overarching constraint of drawer-type dishwashers.

The above-described wash system, while performing satisfactorily, could be improved. For example, the large stainless steel plate is relatively expensive. Also, the annular heating element surrounds the motor so inevitably restricts access thereto. Further, the heating element may be a thick-film heater element printed onto an annular enamel-coated steel base with the thick-film element itself on the side of the enamel base not in contact with the wash liquid. Such a heating element is therefore relatively expensive and its reliability could be improved. Also, because the entire volume beneath the coarse filter plate forms a part of the water flow passage from wash tub to wash pump, and is filled with wash liquid during a normal washing cycle, the volume of washing liquid required for a wash cycle and its associated energy requirement is relatively high. Still further, only a small percentage of the wash liquid actively passes through the fine filter mesh during the wash phase of a wash programme. As a result, recirculating wash liquid avoids the fine filter mesh so that cleaning performance could be improved.

It is therefore an object of the present invention to provide a washing appliance which will go at least some way towards overcoming the above disadvantages, or which will at least provide the public with a useful choice.

SUMMARY OF INVENTION

In a first aspect, the invention consists in a washing appliance comprising:

- a washing tub for holding wash liquid and having a washing space therein adapted to receive items for washing, the washing tub having a base,
- a sump region in the base of the washing tub for collecting wash liquid,
- a wash pump having a wash liquid inlet in fluid connection with the sump region via a wash liquid conduit, and a wash liquid outlet in fluid connection with the washing space, and
- a heating unit positioned in the wash liquid conduit,
- wherein the shape of the wash liquid conduit, in transverse cross-section, is oblong along at least a portion of its length.

In a second aspect, the invention consists in a washing appliance comprising:

- a washing tub for holding wash liquid and having a washing space therein adapted to receive items for washing, the washing tub having a base,
- a sump region in the base of the washing tub for collecting wash liquid, and
- a wash pump having a wash liquid outlet in fluid connection with the washing space and a wash liquid inlet for receiving wash liquid from the sump region,
- wherein plural wash liquid outlets are provided in the sump region in fluid connection with the wash liquid inlet of the wash pump.

In a third aspect, the invention consists in a washing appliance comprising:

- a washing tub for holding wash liquid and having a washing space therein adapted to receive items for washing, the washing tub having a base,
- a sump region in the base of the washing tub for collecting wash liquid, and
- a wash pump having a wash liquid inlet in fluid connection with the sump region and a wash liquid outlet in fluid connection with the washing space,
- a cover plate covering a section of the washing tub base, and
- a wash liquid conduit providing a wash liquid flow passage between the sump region and the wash liquid inlet of the wash pump,
- wherein the wash liquid conduit is formed between the base of the wash tub and the cover plate by a combination thereof.

In a fourth aspect, the invention consists in a washing appliance comprising:

- a washing tub for holding washing liquid and having a washing space therein adapted to receive items for washing,
- a wash pump having a wash pump impeller,
- a pump cap component located in the washing tub, the pump cap component having upper and lower spaced walls, and
- at least one connecting wall connecting between the upper and lower spaced walls of the pump cap component, the connecting wall or walls arranged so as to form a closed shape when viewed from above, the closed shape including a wash pump housing volume for receiving the wash pump impeller.

The invention consists in the foregoing and also envisages constructions of which the following gives examples only. In particular, the invention is mainly described with reference to its implementation in a dishwashing machine, however one skilled in the art will appreciate that at least some aspects of the wash system of the invention is equally suitable for incorporation in other types of washing machines where wash liquid is recirculated. For example, at least some aspects of the wash system according to the a present invention could be directly incorporated into a laundry washing machine, particularly one where space is restricted such as in a low height drawer-type laundry washer (see U.S. Pat. No. 6,618,887B, for example).

BRIEF DESCRIPTION OF DRAWINGS

Preferred forms of the invention will now be described with reference to the accompanying drawings in which.

DESCRIPTION OF EMBODIMENTS

Overview of Washing Appliance

Figure 1:
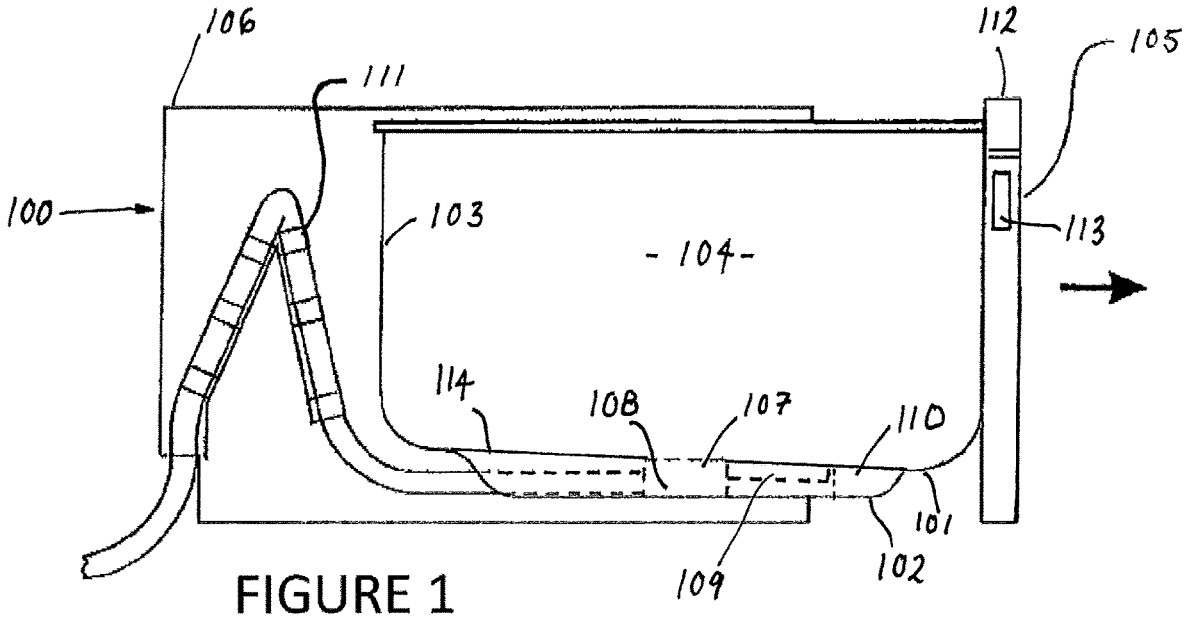
FIG. 1 is a cross-sectional schematic view of a dishwasher incorporating the present wash system.

With reference to the drawings and in particular FIG. 1, an exemplary washing appliance 100 is generally illustrated in which the present wash system may be incorporated. In FIG. 1 the washing appliance is a dishwasher of the drawer-type or drawer-style such as our Dishdrawer™ dishwasher. As mentioned previously, such a dishwasher is disclosed in our prior patent publications WO9323706A and WO9833426A although the wash system could be incorporated within other types of dishwashing machines such as conventional "drop door" dishwashers or "table-top"/benchtop/worktop-style dishwashers (see US20130334940A for an exemplary table-top style dishwasher). The wash system could also be incorporated into other types of washing appliance such as front- or top-loading, or even drawer-style, laundry washing machines.

Figure 2:
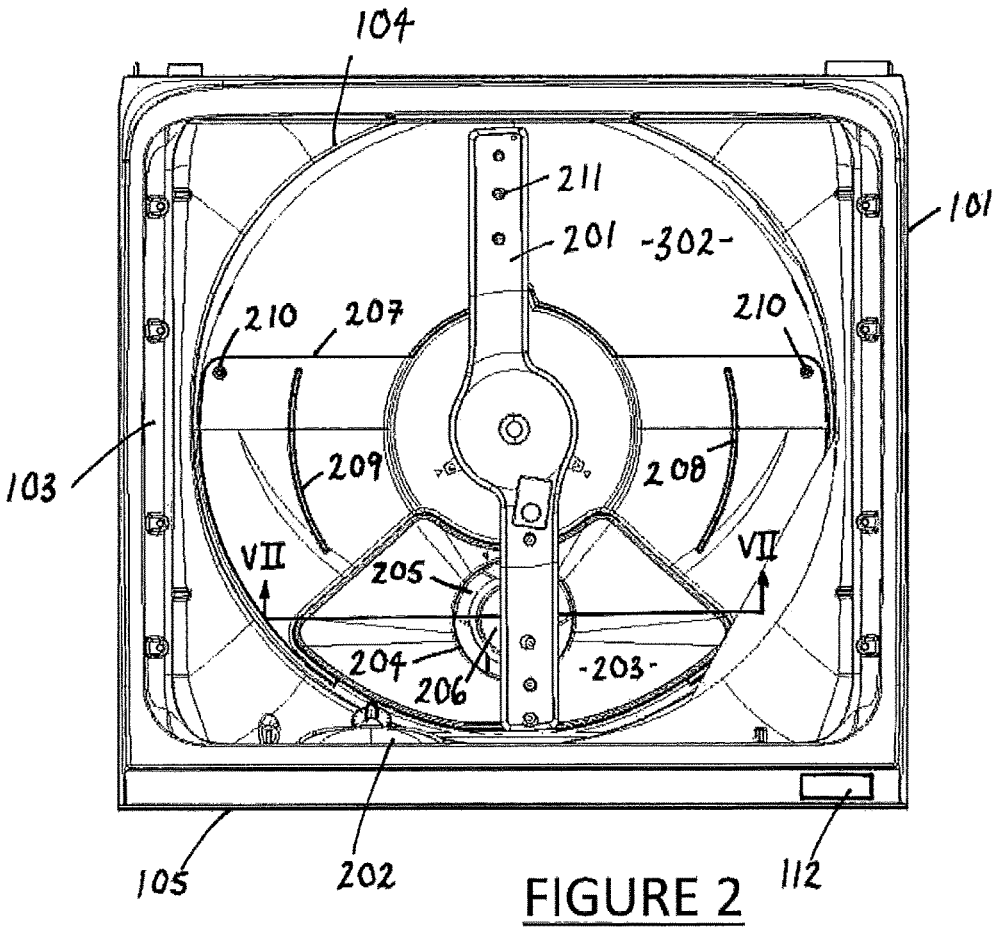
FIG. 2 is a plan view of the wash tub of the dishwasher of FIG. 1 without the cabinet.

The appliance 100 includes a wash tub 101 (which incorporates all wash system components) having a base 102 and either one continuous side wall or separate, connected side walls surrounding or enclosing a wash chamber or wash space 104. As can be seen in FIGS. 1 and 2, the inner surfaces of the wash tub are substantially rectangular prism-shaped although the edges of the inner surface of the base and the lower ends of the side wall(s) meet at a contoured or curved region to aid wash liquid and soil flow from within the wash space, down the wall(s) and onto the upper surface 114 of the base. Wash tub 101 is fitted with a front panel 105 having a handle (not shown) and is slidably mounted within a cabinet 106 in a drawer-style arrangement. The wash chamber 104 has an open top and is withdrawn from the cabinet in the direction of the arrow to allow loading and unloading of dishes or items such as dishware, cutlery, utensils and cookware and is retracted within cabinet 106 while washing occurs. A wash system, which is described in detail below, is fitted within wash tub 101 and may include a drain pump 107, a wash pump 108, a heating device 109 and a filtration system 110 all generally positioned in a lower portion of the wash tub, beneath upper surface 114 of base 102 of the wash tub (surface 114 forming at least part of the floor of the wash chamber or wash space 104).

With reference now also to FIG. 2, a rotatable spray arm 201 (not shown in FIG. 1) is also provided in the wash tub 101, generally in a lower portion of the wash space 104, above base upper surface 114. Spray arm 201, as is well known, is for directing wash liquid, such as a water and detergent mixture, from the wash pump in a spray pattern onto the dishes or other items in wash space 104 for removing soil therefrom. Racking (not shown for the purposes of clarity) is provided within the wash tub, seated against features of the internal surface of the wash tub wall(s), as is also well known to support items to be washed above the height of the spray arm so that it is not restricted against rotation. A detergent/rinse-aid dispenser 202 is provided in a wall 103 of the wash tub which is openable to allow a user to add detergent and/or rinse-aid for a wash load and plumbing is provided within the wash tub to direct wash liquid to flush detergent/rinse-aid from the dispenser during an appropriate part or parts of a wash or rinse cycle.

Flexible electrical wiring and plumbing 111 couples the wash tub 101 to the relevant terminations within cabinet 106 in a manner enabling the aforementioned withdrawal and retraction of the wash tub from/into the cabinet while also enabling power and clean water to be provided to the wash tub, soiled water to be removed from the wash tub and optionally, control signals to be relayed to/from the appliance.

A lid (not shown, but see WO9833426A for various suitable examples) is provided to close the open top of the wash tub when the tub is retracted within cabinet 106. The lid is arranged to seal against the upper rim of the wash tub when in a closed position with the wash tub within the cabinet. The lid is arranged to be retained within the cabinet out of the user's view when the wash tub is opened and may be mounted via a camming arrangement utilising cam followers and camming surfaces which interact in such a way that the lid opens and closes at appropriate positions of the wash tub path into and out of the cabinet. The cam followers and camming surfaces may be provided on either the outside of the wash tub side walls and on the adjacent inner side walls of the cabinet, respectively, or vice versa. Alternatively, the lid may be raised and lowered by motor actuators mounted within the cabinet.

A user interface unit 112 to enable a user to activate various functions or wash programmes of the dishwasher may be mounted in the cabinet 106, in the wash tub 101 (such as on the upper surface of front panel 105 as shown) or may be provided for mounting (wired or wirelessly) remotely from the cabinet/wash tub (such as in a benchtop or wall in a kitchen). User interaction could also be provided additionally or alternatively by way of a remote-control unit (not shown), such as by way of an application programme executed on a user's personal computing device, such as a smart-phone or tablet computer. User input from the user interface unit is provided to a dishwasher controller 113 provided in the cabinet or wash tub and which may be programmed to generate, in response to user-input instructions, electronic control signals for various machine components such as display(s), motor(s), heating element(s) and valve(s) during cycles of machine operation such as pre-wash, washing, rinsing and drying.

In FIG. 2 it may also be seen that the inner lower surface 114 of the wash tub includes a filter plate 203 having a substantially annular sector shape. As will be explained further below with reference to FIG. 4, filter plate 203 provides relatively coarse filtering of soil particles from the wash liquid as it is drawn therethrough and circulated or re-circulated within the wash tub during pre-wash, wash or rinse cycles. The filtered wash liquid is optionally, dependent upon the particular machine cycle, heated by the heating device 109 before returning to the wash chamber via spray arm 201. Within the area of filter plate 203 a substantially cylindrical and much finer or "micro" filter 204 is provided for filtering finer soil particles from the wash liquid. Within microfilter 204 a drain filter 205 is provided for removing larger soil particles (that will not pass through filter plate 203) from the wash liquid for expulsion, via the drain pump, to a kitchen drain. The largest of the soil particles that will not pass through the coarse filter plate, and also will not pass through larger openings in drain filter 205, are blocked and retained by the drain filter and should be cleared therefrom manually by a user of the appliance. A filter cap 206 may be clipped onto the top of drain filter 205.

Because an appliance 100 such as that described above is designed to be suitable for installation beneath a kitchen countertop or benchtop, its maximum vertical height is effectively pre-determined by standard kitchen countertop/benchtop installation heights which are typically between 850 and 900 mm above floor level. As such, the above-described dishwasher is usually constructed with a vertical height dimension approximately half that of conventional under countertop/benchtop kitchen appliances such as front-loading domestic dishwashers or laundry washing machines. In this form it can be used alone or as one of a number, more usually one of a pair of such dishwashers. For example, two such dishwashers may be stacked one above the other under a countertop and the two dishwashers may share a common cabinet. The two dishwashers may be completely independent and independently operated washing appliances or may co-operate, such as by sharing, for example, componentry (such as an electronic controller or user interface) or wash liquid. Alternatively, a single such dishwasher may be mounted beneath a countertop, directly adjacent the underside of the countertop with a cupboard or drawer positioned in the space beneath the dishwasher. Because of the reduced height dimension a dishwasher according to the invention could also be bench-mounted. In order for a consumer to fit larger items in such a reduced-height dishwasher it will be apparent that it is necessary to minimise the vertical height of the wash system to thereby maximise the height of the available wash space 104.

Wash System

It will be appreciated from the above general description that it is desirable to minimise the vertical height taken up by the appliance wash system while obtaining acceptable cleaning, water and energy usage performance at a reasonable cost. The exemplary wash system described below aims to achieve performance improvements in these areas.

The present wash system may include drain pump 107, wash pump 108, heating device 109 and filtration system 110 located in a lower portion of the wash tub 101, generally below or within base 114 (although during washing, the drain pump is not ordinarily an essential wash system component). As will be appreciated, various individual components of the wash system are connected together by conduits to enable the flow of wash liquid therebetween in a water-tight fashion. In the embodiment herein described, the wash tub 101 is preferably moulded from a plastics material such that the side wall(s) 103 are formed separately from base 102 and the tub is formed with a hole into which base 102 is inserted and sealed during assembly. Alternatively, base 102 could be integrally formed with the side wall(s) 103.

Figure 3:
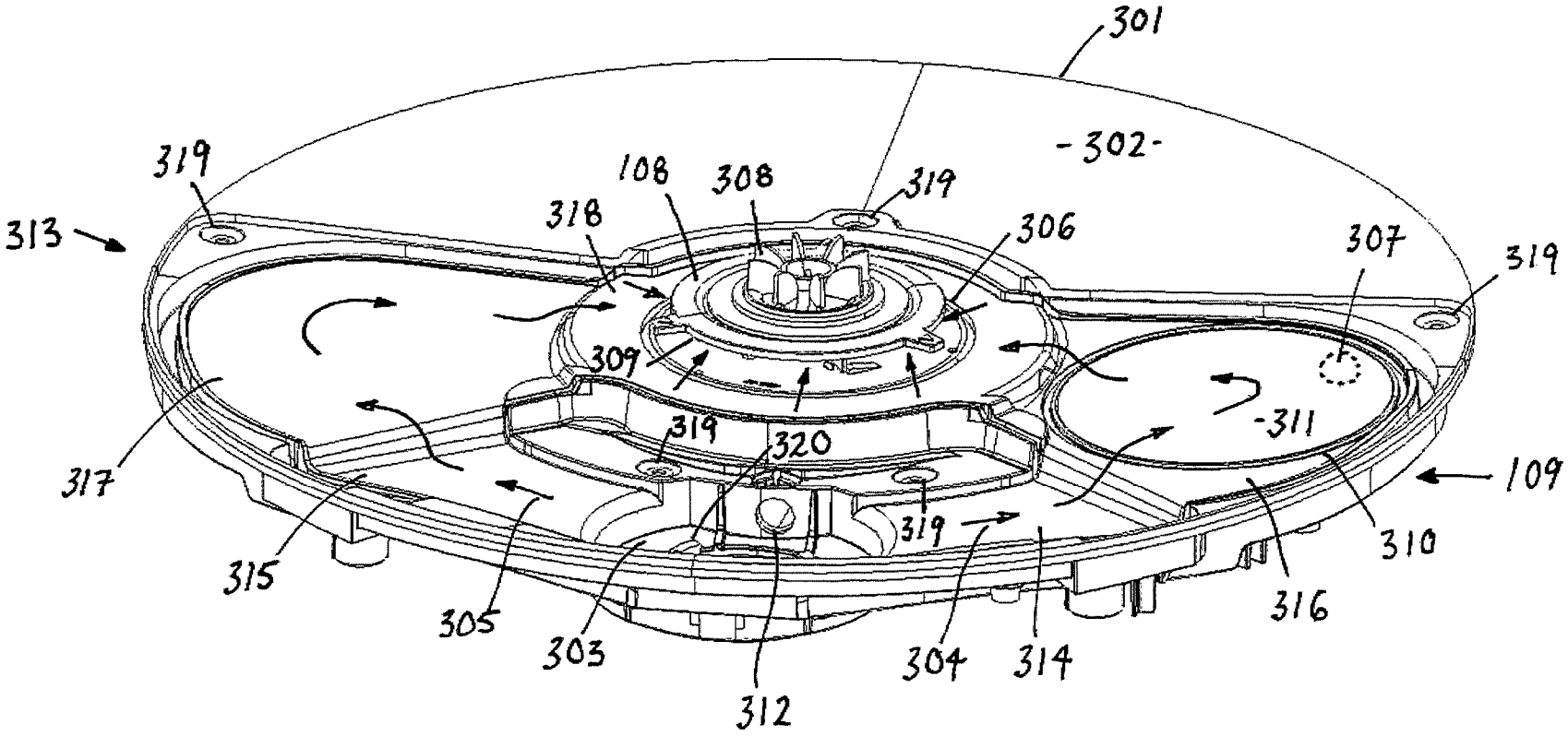
FIG. 3 is perspective view of the inner base of the wash tub of FIG. 2 with the pump cap component, spray arm and filter plate removed.

FIG. 3 illustrates a separately-formed wash tub base insert 301 forming the aforementioned base 102 of the wash tub. Wash tub base insert 301 is substantially circular in plan view and fits within a similarly-shaped opening in the bottom or lower wall of the wash tub preferably with a seal, such as an elastomeric seal, compressed therebetween. As best seen in FIG. 2, filter plate 203 (not shown in FIG. 3) is located in a matchingly-shaped recess in a pump cap or cover component 207 (also not shown in FIG. 3—see FIGS. 5 and 6) which is itself located in a matchingly-shaped recess in wash tub base insert 301. Preferably, the wash tub 101, including the separately-formed base insert 301 and pump cap component 207, is formed from a plastics material such as polypropylene.

Base insert 301 may have a first section 302 on its upper face that is substantially planar and forms a part of the inner surface of the wash tub. In the embodiment shown, the first section 302 extends over a circumferential extent of about 180° of the base insert. When installed in the wash tub and in use in a washing appliance the first section 302 should preferably be inclined slightly from horizontal to encourage wash liquid and soil to flow or migrate from the side opposite filter plate 203, down towards the filter plate. The remaining section 313 of base insert 301 is recessed below the surface of section 302 and incorporates a sump region 303 and surfaces which form, in combination with pump cap component 207, substantially "flat" or low-profile (that is having a low vertical height compared to their horizontal width) wash liquid conduits (explained in more detail below) which contain wash liquid flow paths 304, 305 via which wash liquid is drawn from the sump region 303 and travels to the inlet of wash pump 108.

Wash Pump and Drain Pump

The wash tub base insert 301 includes a first opening 306 which is preferably centrally-located and to the underside rim of which wash pump 108 is fitted and sealed. As mentioned previously, the wash pump may be the same as that described in our prior publication WO9833426A or WO9312706A. Such a pump is a combined wash pump and drain pump with separate wash 308 and drain (not shown) impellers mounted on a common shaft wherein the geometry of the impellers and the chambers in which they are rotated ensures that shaft rotation in a first direction effectively activates only the wash pump and shaft rotation in the opposite direction effectively activates only the drain pump. This design of pump is particularly space efficient. However, it is not essential that such a combined wash/drain pump be utilised and independent wash and drain pumps could alternatively be installed in or beneath wash tub base insert 301. A drain inlet 312 is provided in sump region 303 which is connected by a drain conduit to drain pump 108. When the drain pump impeller is activated, by rotation of the pump shaft in the appropriate direction, wash liquid is drawn through drain inlet 312 to the drain pump impeller and then, via a drain outlet conduit, to an external drain such as a kitchen drain pipe.

As shown in FIG. 3, the wash pump impeller 308 protrudes above the level of the surface of first base insert section 302. The particular style of wash pump impeller shown in FIG. 3 draws wash liquid radially inwardly via an annular inlet 309 and generates an upward axial outlet flow of wash liquid from wash pump impeller 308. This outlet flow of wash liquid from wash pump 108 is supplied to spray arm 201 (see FIG. 2) which distributes the wash liquid in the wash space 104 to wash/clean/rinse items positioned within the wash space. As shown in WO9312706A, the spray arm may be hollow and located over the wash pump impeller with a central, integral wash pump casing having radially-opposed delivery volutes channelling wash liquid outwardly towards spray nozzles 211 in the upper surface of the spray arm. Such a spray arm includes a circular opening in its lower surface which enables the wash pump impeller 308 to be located inside the wash pump casing when the spray arm is installed in the wash tub and to develop liquid pressure within the spray arm to thereby generate a desirable, upwardly directed wash liquid spray pattern within the wash space via the spray nozzles.

Heating Device

As can be seen from FIG. 3, there is a basic symmetry to the shape of the wash tub base insert 301 about a line in the plane of the base insert which passes through the centre of sump region 303 and the centre of wash pump impeller 308. Section 313 of wash tub base insert 301 includes four substantially planar regions, the lowest being the base or bottom surface of sump region 303 which, following the arrows in either direction steps up, in a curved manner, to two separate second level planar regions 314, 315 either side of the sump region. Following flow paths 304, 305 from regions 314, 315 respectively towards the wash pump inlet 309 there is next a further curved step up to third level planar regions 316, 317. From regions 316 and 317 there is a further curved step up to a fourth level planar region 318 which is substantially annular and centrally contains the first opening 306, to the rim of which the wash pump 108 is mounted and sealed. Preferably the fourth level planar region 318 is substantially or nearly horizontal when the wash tub is installed and in use, and substantially flush with the lower surface of wash pump inlet 309. Third level planar regions 316 and 317 are preferably slightly angled or sloped so that wash liquid in flow paths 304, 305 arrives from a lower height and exits to the step up to the fourth level planar region 318 at a greater height. Similarly, regions 314 and 315 are preferably slightly angled or sloped downwardly towards their respective down-stream sides at sump region 303.

The wash tub base insert 301 also includes a second opening 310 provided for receiving heating device 109 therein. The heating device 109 preferably includes a flat circular heat conductive plate 311, such as a polished stainless steel plate, which sits flush with the surrounding surface of the third level planar region 316 of the wash tub base insert. An annular seal, such as a flexible radial seal with plural axially-spaced sealing ribs may be provided between the periphery of opening 310 and the perimeter of heater plate 311 so that washing liquid is unable to pass through opening 310. Means, such as a resistive heating element, are heat-conductively bonded to the underside of conductive plate 311 and suitable wiring and circuitry are provided to enable the heating means to be powered on and off at suitable times during cycles of the washing appliance to thereby control the temperature of plate 311 and, thereby, the temperature of the washing liquid flowing thereover.

One or more temperature sensor 307 or thermal limiter may be heat-conductively attached to the lower side of plate 311 to detect the temperature thereof and provide a temperature signal to dishwasher controller 113 or to a local heater power supply unit. In response to the temperature signal, power to the heating element may be modulated to maintain a suitable plate surface temperature. Alternatively, power to the heating element may be modulated or interrupted without temperature feedback to a controller but the temperature sensor or thermal limiter may be operable as a safety device in case the heater plate temperature exceeds a predefined upper limit. Exceeding of an upper temperature safety limit may occur, for example, if an air pocket develops in the flow of washing liquid over the heater plate, even when wash liquid is still passing over some of the heater plate surface. In such circumstances the heat removed from heater plate 311 by the washing liquid will be less than expected and its temperature will rise. It has been found that the aforementioned slight incline to the surface of region 316 and to heating device 109 results in any such air pocket migrating to the vertically-raised side of the heater plate. Accordingly, locating the one or more temperature sensor 307 at or near the underside of the inclined or raised edge of the heating device improves the detection of such situations and prevents overheating.

As indicated by the arrows in FIG. 3, two separate, independent wash liquid flow paths 304, 305 are provided between the sump region 303 and the inlet 309 to wash pump 108. Although only a single heating device 109 is shown included and positioned in the right-hand-side wash liquid flow path 304, two or more heating devices could be installed. For example, a second heating device could be located opposite heating device 311 in a hole in region 317 of the left-hand-side wash liquid flow path 305. However, it has been found that a single heating device provides adequate heating performance. It has been found that the above-described "symmetrical" arrangement of dual flow paths from sump region 303 to the inlet 309 of wash pump 108 provides the pump with a balanced or even distribution of wash liquid around its entire inlet which maximises utilisation of the inlet and aids in stable operation of the wash pump.

Wash Liquid Conduit(s)

It will be appreciated that the above description refers to wash liquid in flow paths 304, 305 being drawn towards the wash pump inlet. This is possible because regions 314, 315, 316, 317 and 318 of base insert 301, together with their intermediate steps, form part of a wall of a wash liquid conduit fluidly connecting sump region 303 to inlet 309 of the wash pump. The remainder of the conduit wall is provided by surface features of the underside of pump cap component 207 or base insert 301. More particularly, two separate wash liquid conduits are preferably formed between sump region 303 and inlet 309. A first conduit includes regions 314, 316 and 318 as its lower wall and a second conduit includes regions 315, 317 and 318 as its lower wall. It will also be appreciated that heating plate 311 is located in and sealed to an opening in this first conduit such that the surface of heating plate 311, once installed, also forms part of the lower wall of the first conduit.

Figure 5:
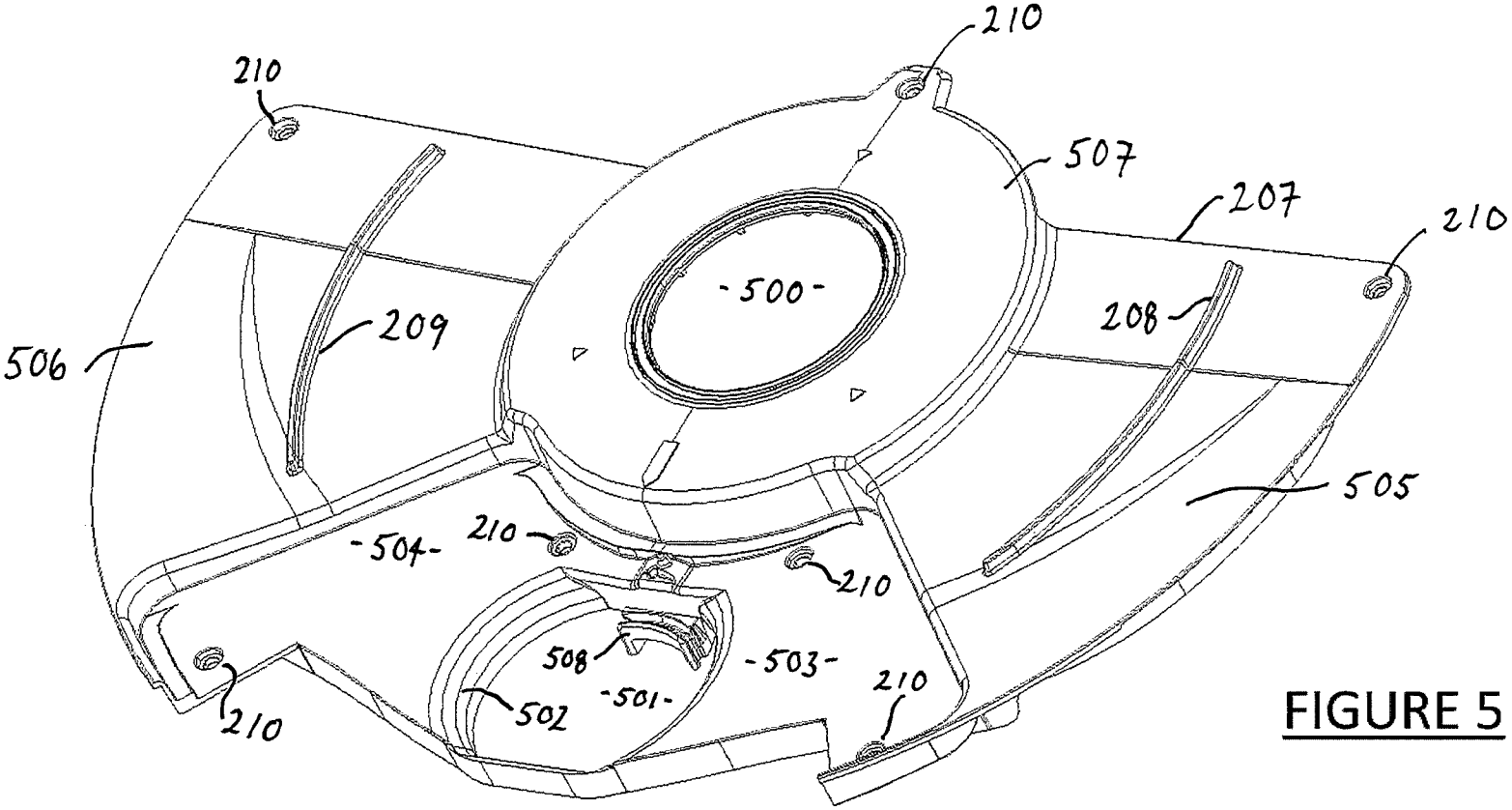
FIG. 5 is a perspective view from above of the pump cap component shown in FIG. 2.
Figure 6:
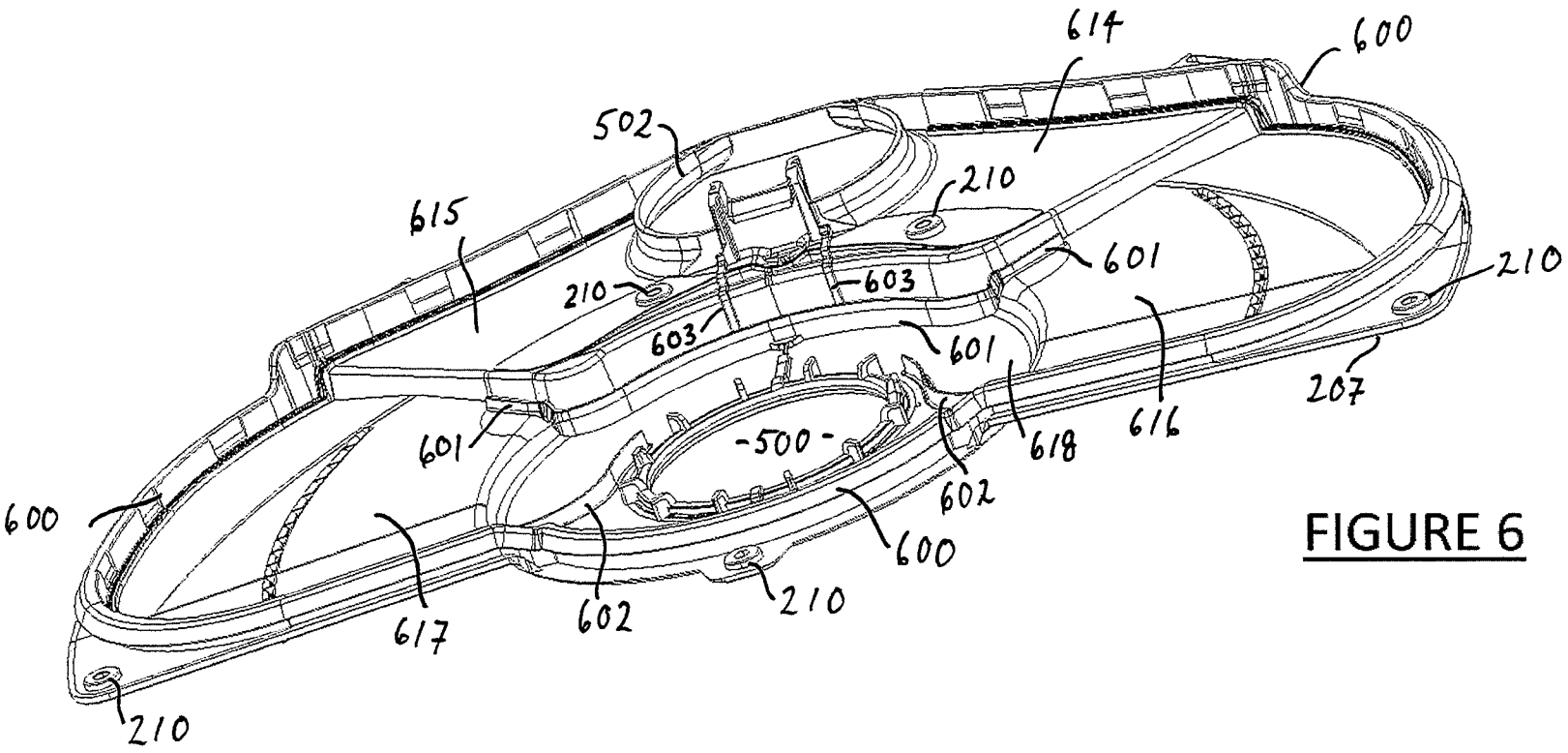
FIG. 6 is a perspective view from below of the pump cap component of FIG. 5.

With reference now to FIG. 5 which shows the upper side of the pump cap component 207 and in particular initially to FIG. 6 which shows the underside of the pump cap component, it may be seen that the underside includes regions 614, 615, 616, 617 and 618 and intermediate steps which substantially match those referred to above in base insert 301. Accordingly, once pump cap component 207 is installed in its recess in base insert 301, region 614 is directly opposite, spaced from and substantially parallel to region 314, region 615 is directly opposite, spaced from and substantially parallel to region 315, region 616 is directly opposite, spaced from and substantially parallel to region 316, region 617 is directly opposite, spaced from and substantially parallel to region 317, and region 618 is directly opposite, spaced from and substantially parallel to region 318. That is, regions of the underside surface of pump cap 207 provide at least part of the upper wall of each conduit.

Region 618 may be provided with wash liquid flow directing vanes 602 to help ensure an even circumferential delivery of wash liquid about wash pump inlet 309. An opening 500, preferably a circular opening, in pump cap component 207 is provided to enable the wash pump impeller 308 to protrude therethrough and into the wash space. The top side of the rim of opening 500 may seat against an annular flange of wash pump 108. A further opening 501 is provided in pump cap component 207, aligned in its installed location within base insert 301 with sump region 303. The surface of pump cap component 207 surrounding opening 501 is drawn or curved downwardly about at least a substantial extent of opening 501 to form a funnel surface 502 which extends somewhat into sump region 303, beneath the surface of regions 314 and 315 of base insert 301, when pump cap component 207 is installed in the base insert.

It can also be seen in FIG. 6 that a flexible seal 600 of, for example, elastomeric material is adhered to, over-moulded or co-moulded with the pump cap component about most of a periphery of the pump cap component. Seal 600 ensures a liquid-tight seal on one side (the "outer side") of the conduits, between the conduits' lower and upper walls. A further flexible seal 601 adhered to, over-moulded or co-moulded with the pump cap component ensures a liquid-tight seal between the upper and lower walls of the conduits on the other, "inner" side. Seal 601 may, for example, extend circumferentially around about 90° of the sump region-side of annular planar region 618. It may also be seen that for each of the first and second conduits, following the wash liquid flow path within the conduit towards the wash pump inlet, one side face of seal 601 firstly forms part of the inner side wall of the conduit and then the opposite side face of seal 601 forms part of the inner side wall for a segment of the conduit closer to the pump inlet. Seal 601 also includes short segments 603 which are located to seal the final segment of the inner walls of the conduits. The inlets or mouths of the conduits (which may equally be described as the outlets of the sump region) are thus positioned on opposed sides of the sump region and each includes at least an arc of a space between the overlapping funnel-shaped wall 502 and the adjacent curved upper lip of the sump region (see FIG. 7). It will therefore be appreciated that the completely enclosed conduits thus formed by the opposed base insert and pump cap enable a low pressure at pump inlet 309, caused by operation of wash pump 108, to be transferred to a low pressure at the inlet end of the conduits at the sump region thereby producing and containing the aforementioned respective wash liquid flow paths 304, 305 therein.

It will also be appreciated that the shape of the above-described conduits are substantially "flat"—that is, having opposed substantially planar surfaces which are spaced apart by a height distance that is much less than the narrowest width of the conduit—along at least a portion of their length. Preferably, the flat shape of the conduit is provided along more than half of its length, more preferably along most of its length and even more preferably along its entire length. In transverse cross-section, when cut by a vertical plane, the shape of the conduits are generally substantially rectangular, elliptical or oblong with the upper and lower walls forming the opposed longer sides. The transverse cross-section of the conduits may be described as having substantially perpendicular width and height dimensions, the width dimension being much greater than the height dimension. Although the width of each conduit varies along its length between about 120 mm (the diameter of heating plate 311) to about 55 mm (at the sump region end), and the width of the annular section 318 is about 25 mm, the height of each conduit is substantially uniform, ranging between about 5 and about 8 mm. Along most of the length of each conduit, excluding annulus 318, the transverse cross-sectional width is at least about ten times the transverse cross-sectional height. The low height or profile of the conduits means that they beneficially minimise height utilisation within the wash tub. The low height of the conduits also means that the conduits hold a relatively low volume of wash liquid thereby minimising wash liquid held in the wash system during a cycle of the dishwasher so that water and energy (heating) efficiency are improved. The low volume of the conduits also means that for a given wash pump flow rate, wash liquid velocity through the conduits increases compared to conduits occupying a greater volume. This higher wash liquid flow rate is beneficial in the present design as it reduces or eliminates the occurrence of "soil baking" on the heating plate 311 which might otherwise occur when soil particles have a lower velocity across the surface of the heater plate and can become "baked on". "Baked on" soil particles become permanently attached to the heating plate surface thereby reducing the efficiency with which the heating unit is able to provide heat to the wash liquid flow and also restricting the rate of flow of wash liquid through the conduit. The wash liquid velocity over the surface of heating plate 311 may be around 0.5 to 1.0 m/s with the surface temperature of the heating plate at about 10° C. above the temperature of the wash liquid.

The upper surface of pump cap component 207 may have formed therein flow control vanes 208, 209 to help direct the wash liquid in the wash space toward the filter plate with the aid of a slight incline of the wash liquid-contacting surface of the base insert (that is, first section 302) and pump cap component 207 from the side opposite the filter plate or sump region 303 (that is, the higher side is the top side in FIG. 2) towards the filter plate or sump region. To enable the two components to be releasably connected together during manufacture or servicing, provision is made in both base insert 301 and pump cap component 207, such as corresponding screw hole bosses 319 and 210 respectively for receiving fixing means such as screws. When filter plate 203 is installed in its recess in pump cap component 207, and pump cap component 207 has been installed in its recess in wash tub base insert 301, the upper surface of the thus formed integrated base panel of the wash tub has a substantially smooth and flush transition from the wash space surface of one component to the wash space surface of the adjacent component to minimise resistance to the flow of wash liquid and soil towards filter plate 203 and sump region 303. Annular planar region 318 is preferably substantially horizontal in use so that the rotational axis of the wash/drain pump is substantially vertically aligned and the spray arm rotates in a substantially horizontal plane. The angle of inclination of the planar upper surfaces of region 302, 506 to 507 (see FIG. 5) away from horizontal may be between about 1° and about 3°, more preferably about 2°.

Figure 7:
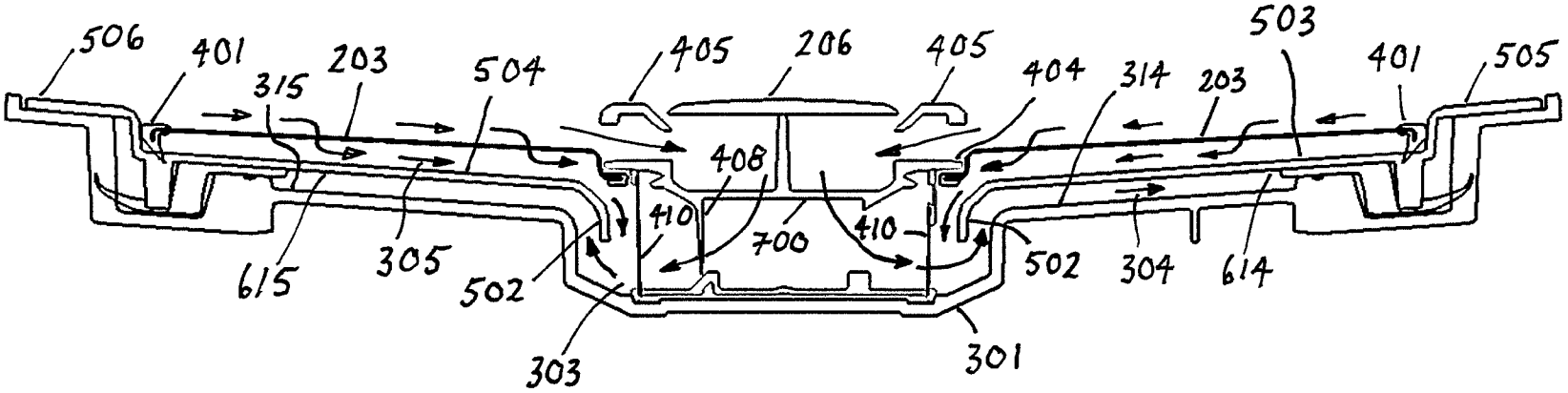
FIG. 7 is a simplified cross-sectional view through line VII-VII of the base of the wash tub of the dishwasher of FIG. 1.

It will therefore be appreciated that a contra-flow of wash liquid exists on either side of pump cap component 207, as illustrated by the arrows in FIG. 7. That is, whilst wash liquid is being drawn from sump region 303 in an anti-clockwise arc along flow path 304 through the first conduit over region 314 then region 316, heater plate 311 and region 318 to the inlet of the wash pump, some wash liquid returning from the wash space of the wash tub back to the sump region does so in a clockwise arc on substantially planar region 505 (see FIG. 5) of the upper surface of pump cap component 207 on either side of vane 208 and then across/through filter plate 203 towards the drain filter. Of this wash liquid traveling in a clockwise arc, that which passes through filter plate 203 then passes over a substantially planar surface 503 towards opening 501. Regions 505 and 503 of pump cap component 207 are arranged to be substantially parallel to regions 316 and 314, respectively of the base insert, Accordingly, the previously-described incline of regions 316 and 314 downwardly towards sump region 303 means that a similar incline exists on the upper surface of pump cap component 207 which assists in urging wash liquid wash to return quickly to the sump region from the wash space to avoid pump "starving" (insufficient wash liquid at the inlet) and subsequent loss of prime. This incline also aids in migration of larger soil particles over region 505 and across the surface of filter plate 203 and into drain filter 205.

Of course, the same contra-flow arrangement exists on the opposite side of the base insert where a lower, clockwise flow passes along flow path 305 through the second conduit over region 315 then region 317, and region 318 to the inlet of the wash pump. Some wash liquid returning from the wash space of the wash tub back to the sump region does so in an anti-clockwise arc on substantially planar region 506 of the upper surface of pump cap component 207 on either side of vane 209 and then across/through filter plate 203 towards the drain filter. Of this wash liquid traveling in an anti-clockwise arc, that which passes through filter plate 203 then passes over a substantially planar surface 504 towards opening 501.

As mentioned above, it is not essential that both flow paths 304 and 305 are provided as the wash system will be effective with only a single flow path. However, it has been found that the above-described double-sided or symmetrical flow path arrangement is particularly beneficial. Firstly, two flow paths between sump region and wash pump effectively halves the volume of wash liquid and soil that each flow path needs to handle, allowing the height of the flow paths to be reduced. Secondly, as also mentioned previously, two flow paths providing returned wash liquid to the wash pump inlet can be arranged to more effectively utilise the entire area of the inlet, particularly in the present case where the inlet is an annular region. Thirdly, two separate flow paths of wash liquid and soil returning from the wash space to the sump region enable more effective utilisation of the entire area of the filter plate surface, particularly when the drain filter opening is centrally-located beneath the filter plate so that soil in the wash liquid is divided into two paths that approach the drain filter in opposite directions. Reducing the amount of soil in any particular liquid flow over the filter plate reduces the amount of soil that may be left in any particular area of the filter plate if the liquid flow over the filter plate is insufficient to wash it into the drain filter. A fourth benefit to a dual flow path design, which will become clearer with further explanation of the filtration system, is a more efficient utilisation of the surface area of microfilter 204 about its entire circumference.

It has been found that because the spray arm rotates in one direction, wash liquid returning to the sump region tends to be biased towards approaching the drain filter in the same circular direction, reducing the third of the above-mentioned beneficial effects. However, this effect may be mitigated by flow control vanes positioned appropriately on the internal surfaces of the wash tub, particularly on the curved regions surrounding base insert 301. For example, such flow control vanes may be arranged in a symmetrical fashion with those on the right hand side (the heater plate side) of the wash tub being aligned so as to urge wash liquid and soil flowing down the wash tub wall(s) to flow in a clockwise direction towards the drain filter and the vanes on the other side of the wash tub aligned to urge wash liquid and soil in an anti-clockwise direction.

Filtration System

Figure 4:
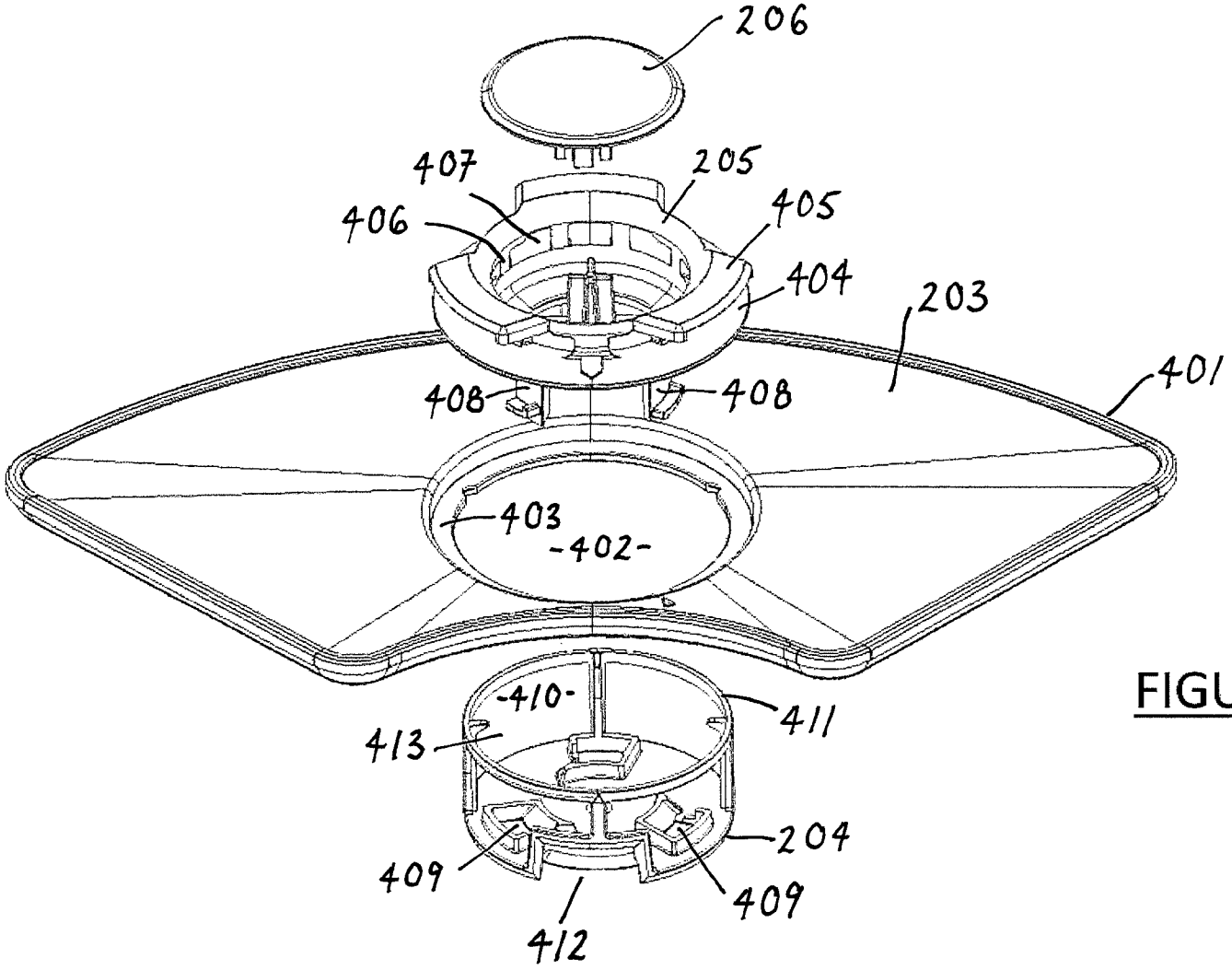
FIG. 4 is an exploded view of the filtration system within the base of the wash tub of FIG. 2.

With particular reference now to FIG. 4, the main, normally visible part of the filtration system is filter plate 203 which may, for example, be formed from a substantially flat metal plate covered by a large number of closely-spaced holes through which wash liquid and smaller soil particles may pass. The filter plate provides a relatively coarse level of filtering to the wash liquid and the holes therein are of the order of 0.7 to 1.0 mm in diameter. The outer perimeter of filter plate 203 is preferably provided with a flexible or elastomeric seal 401 such as by over-moulding or co-moulding. The holes in filter plate 203 may be acid etched so that rough or sharp hole edges may be avoided. Filter plate 203 is provided with a central opening 402 to enable drain filter 205 to pass therethrough. The recessed edge of opening 402 may also be provided with a flexible or elastomeric seal 403. The edge seals enable the filter plate to be sealed to a matchingly-shaped recess in pump cap 207 and to a flange 404 of drain filter 205 so that wash liquid in the wash space 104 must either pass through filter plate 203 or drain filter 205 in any wash, rinse or drain cycle on its way to either the drain pump inlet 312 or wash pump inlet 309. Larger soil particles that cannot pass through the holes in filter plate 203 pass across its surface and enter sump region 303 via drain filter 205. To assist soil particles to traverse filter plate 203 and enter drain filter 205 the filter plate may be slightly "dished" in shape so that when installed in its location in pump cap component 207 the outer edge is raised slightly higher than the filter plate surface around opening 402.

Microfilter 204 is preferably a substantially cylindrical filter mesh 410 such as a stainless steel mesh arranged with its axis substantially perpendicular to the plane of filter plate 203. Microfilter 204 has much smaller holes in its mesh surface than the size of the holes in filter plate 203. The hole size in the microfilter mesh may be, for example, between about 0.3-about 0.5 mm in diameter. The filter mesh 410 is maintained in its cylindrical shape by a frame 411 which may extend about the top and bottom circular edges and also may include reinforcing beams extending between the top and bottom edges. An opening 412 is provided in the cylindrical wall of the microfilter opening 412 enables soil particles trapped within the drain filter, but which are not so large that they are trapped by the labyrinth filter, and which are too large to through the microfilter mesh, to exit the sump region via the drain pump inlet. Opening 412 is therefore arranged to be aligned with drain filter inlet 312 and to accomplish this, the frame 411 in the region defining the edges of opening 412 forms a substantially inverted "U" shape which is adapted to slide axially over a correspondingly-shaped drain inlet hood (see FIG. 5) within opening 501 of pump cap component 207. The periphery of hood 508 may include a groove for receiving the section of microfilter frame 411 surrounding opening 412.

Drain filter 205 includes plural, for example three, gripping projections 405 which a user may grasp in order to remove/rotate the drain filter, along with cap 206, filter plate 203 and microfilter 204 which together form a removable filtration system. The user may occasionally remove the filtration system for cleaning and for removing large soil particles trapped in the drain filter. Beneath the gripping projections 405, the drain filter includes a substantially cylindrical filter wall 406 containing a series of openings 407. Openings 407 may have dimensions of about 12 mm by about 7 mm, for example, through which large soil particles may progress from filter plate 203. Particles too large to pass through openings 407 will remain on filter plate 203. Large soil particles that pass through openings 407 may then encounter a labyrinth filter comprising, for example, at least one shelf 700 (see FIG. 7) extending substantially horizontally from one side of the substantially cylindrical filter wall, beneath openings 407, to or near a diameter of the cylindrical filter wall. That is, the shelf effectively closes off about a half of the cross-sectional area within the cylindrical wall.

Below shelf 700, a plurality of depending legs 408 (for example, three symmetrically-spaced depending legs) extend downwardly with mating cam surfaces extending laterally from their distal ends. The cam surfaces are removably lockable, by relative rotation for example, into or beneath protruding hook members 320 (the top part of one of which is just visible in FIG. 3) formed in the base of sump region 303. Microfilter 204 includes a substantially planar base 413 into which are formed openings 409 having a moulded surrounding wall. When correctly installed, each opening 409 of the microfilter receives a corresponding protruding hook member 320. Subsequently, filter plate 203 is inserted into its matchingly-shaped opening in filter cap 207, above regions 503, 504 and sump region 303. The drain filter 205 (with attached filter plate) may then be inserted axially into opening 402, until the lower surface of flange 404 seats against seal 403, and then rotated so that the cam surfaces on legs 408 are each retained beneath a surface of a protruding hook member 320. The shape of the cam surfaces on legs 408 cause the drain filter and filter plate 203 to be drawn downwardly towards base insert 301 upon rotation of the drain filter with respect to the sump region. Sufficient rotation (clockwise from above, for example) of the drain filter reaches a detent position or end-stop stable position so that the drain filter, filter plate and microfilter are effectively locked to the base insert. Rotation of the drain filter in the opposite direction returns the filtration system components to their unitary, removable states.

In FIG. 7, which is a simplified cross-sectional view through the filtration system and wash tub base insert, wash liquid may enter the sump region either via the openings 407 of drain filter 205, in which case it encounters the downstream cylindrical mesh 410 of microfilter 204, or it may bypass the microfilter and enter the sump directly from regions 503, 504 of pump cap component 207 after having passed through filter plate 203. These two flows combine and are drawn upwards into the inlet of the first and second conduits by the wash pump to thereby form wash liquid flow paths 304 and 305, respectively, which then travel on to wash pump inlet 309 (with wash liquid in flow path 304 optionally being heated). The wash liquid flow path that passes through filter mesh 410 receives a higher level of filtering than the bypass flow. The size or area of the annular space between funnel 502 and the cylindrical filter surface along with the wash pump's flow rate determine to a large extent the ratio of micro-filtered flow to bypass flow. This ratio may be arranged, in conjunction with wash program duration, to ensure that the microfilter's cylindrical mesh filter surface 410 is unlikely to be block during a complete cycle of the dishwasher. As mentioned above, the preferred dual flow path design of the present wash system enables more effective utilisation of the entire circumference of the microfilter's mesh to also aid in avoiding blockage of the entire surface during a cycle. A further means for avoiding total blockage of the microfilter mesh may be provided by short bursts of operation of the drain pump during wash/rinse cycles. These bursts may last from about 4 seconds to about 8 seconds, for example, and result in reversal of direction of the wash liquid through the mesh surface and thus help to clear blockages therefrom. However, should the microfilter's entire mesh surface be blocked by soil, recirculation of wash liquid is still possible via the bypass flow channel.

Further Embodiment

With reference now to FIGS. 8 to 14 a "table-top" or "bench-top" style dishwashing appliance 800 incorporating a further embodiment of the present wash system will now be described. Such a dishwasher 800 is adapted to be temporarily positioned on a bench- or counter-top during use and connected to a water supply such as a cold kitchen water tap and an electrical power source. An outlet hose (not shown) may be provided from the dishwasher's drain pump outlet whereby the outlet hose is adapted to be connected to a domestic drain pipe or to drain into the user's kitchen sink. Once the washing cycle of the dishwasher 800 is completed, it may be unloaded and then the dishwasher returned to a storage location such as a cupboard or a shelf.

Figure 8:
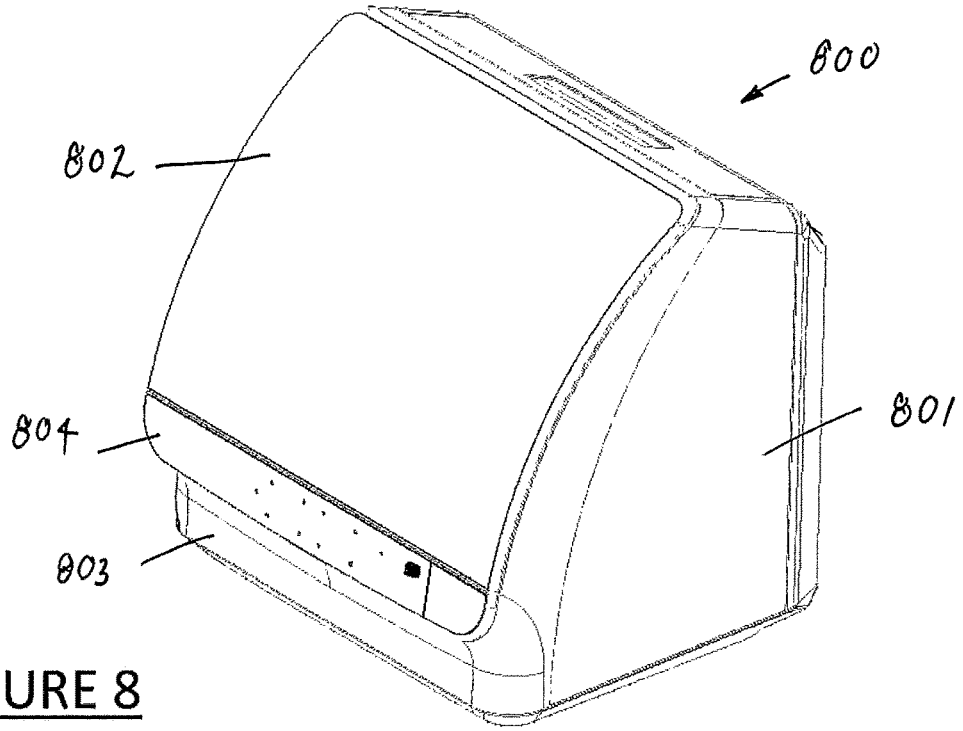
FIG. 8 is a perspective view of a "table-top" style dishwasher incorporating an embodiment of the present wash system.

The dishwasher 800 includes a cabinet 801 and a door 802 which is openable by a user to allow access to the interior of the cabinet for loading dishes and cooking utensils for washing and to enable subsequent unloading via an opening 900 in the cabinet. The door 802 may be rotatable about a horizontal axis, as in the abovementioned US20130334940A, or it may be hinged to the cabinet 801 to enable the door to pivot and/or translate toward or away from the opening 900 in the cabinet. When in its closed position as shown in FIG. 8 the door preferably provides a seal about the opening 900 to avoid sprayed water, and water flowing on the inside of the door, from exiting through the opening. The cabinet and door may optionally be formed from a plastics material or could, for example be formed from painted steel or stainless steel. The door may be formed from a transparent or semi-transparent material such as a toughened glass. A control panel 804 may be provided at a front-facing surface of the cabinet to enable a user to activate the appliance and set and change operating cycle instructions to a machine controller connected to control the energisation of the wash/drain pump, heating element, inlet water supply and optionally, a door lock. The dishwasher 800 may also be provided with a detergent dispenser, rinse aid dispenser and water softener in the known way.

Figure 9:
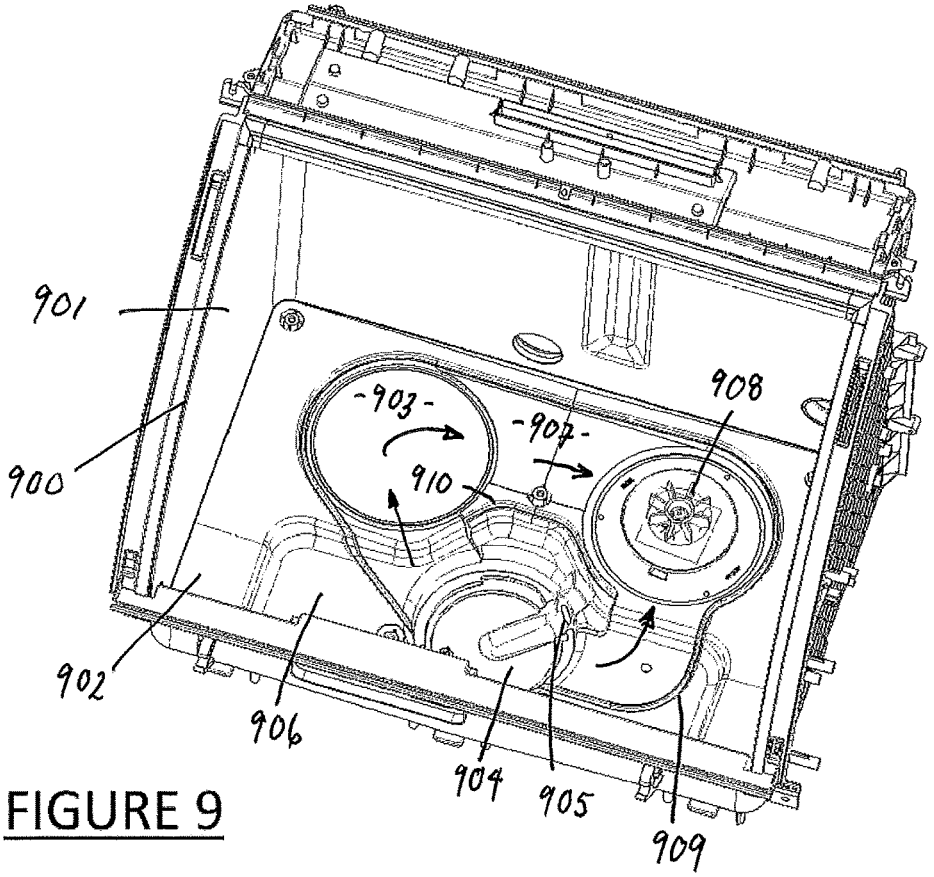
FIG. 9 is perspective view of the dishwasher of FIG. 8 directed at the tub base with the door, some external panelling, the filtration system and pump cap component removed.

As shown in FIG. 9, in a corresponding fashion to previously-described dishwashing appliance 100, the interior of dishwasher 900 includes a wash tub 901 having a tub base 902. The tub base is preferably formed from a plastics material although it could be at least partially formed from, for example, stainless steel. Tub base 902 may be integral with the walls of the tub or may be attached or welded thereto with a substantially water-tight seal therebetween. The lower edge of the opening 900 is stepped above the height of the tub base 902 a short vertical distance by a front wall 803 so that, in operation, a volume of water may be held within the tub without escaping and so that wash system components may be accommodated within the tub, below the lower level of the opening.

A heating plate 903, wash pump (not shown) and drain pump (not shown) are provided in tub base 902 in a similar manner to that previously described with respect to dishwashing appliance 100. Again, the wash and drain pumps may be provided as a combined pump unit. As was previously described, a sump region 904 is provided at a lower level of the tub base with a drain inlet 905. The sump region steps up to a second level substantially planar region 906 on either side of the sump and a further step is provided up to the upper level 907 of the tub base in which sealed openings are provided for the heating plate 903 and wash pump impeller 908. An elongated groove feature 909 is formed or moulded into the tub base to define the perimeter of a zone including sump 904, heating plate 907 and impeller 908. A further elongated groove feature 910 is provided in or on tub base 902 within the zone defined by groove feature 909 to divide the zone into separate areas as will be explained below.

As will be explained in more detail below, a pump cap component is positioned above tub base 902 and has features on its underside, such as an over-moulded elastomeric seal member or members, that contact and preferably compress within groove features 909 and 910 to form a seal or seals therewith. The pump cap component also preferably includes a seal around its perimeter to avoid soil-containing washing liquid from passing between it and the wash tub wall, bypassing the (still to be described) filtration system and potentially entering the sump region. As a result, as in the previous embodiment, the underside of the pump cap component and the upper side of tub base 902 within the zone inside member 909, form the upper and lower sides of low height or low profile, substantially flat and/or oblong conduits interconnecting the sump, heating plate and wash pump impeller. During a washing cycle, these substantially flat or oblong conduits form a bifurcated path for drawing and channelling filtered washing liquid from the sump region to the wash pump impeller, with at least one leg of the path passing over the heating plate to optionally warm the washing liquid, as shown by the arrows in FIG. 9. As previously explained, a single path/channel between sump and impeller may be sufficient, with or without a heating element.

Figure 10:
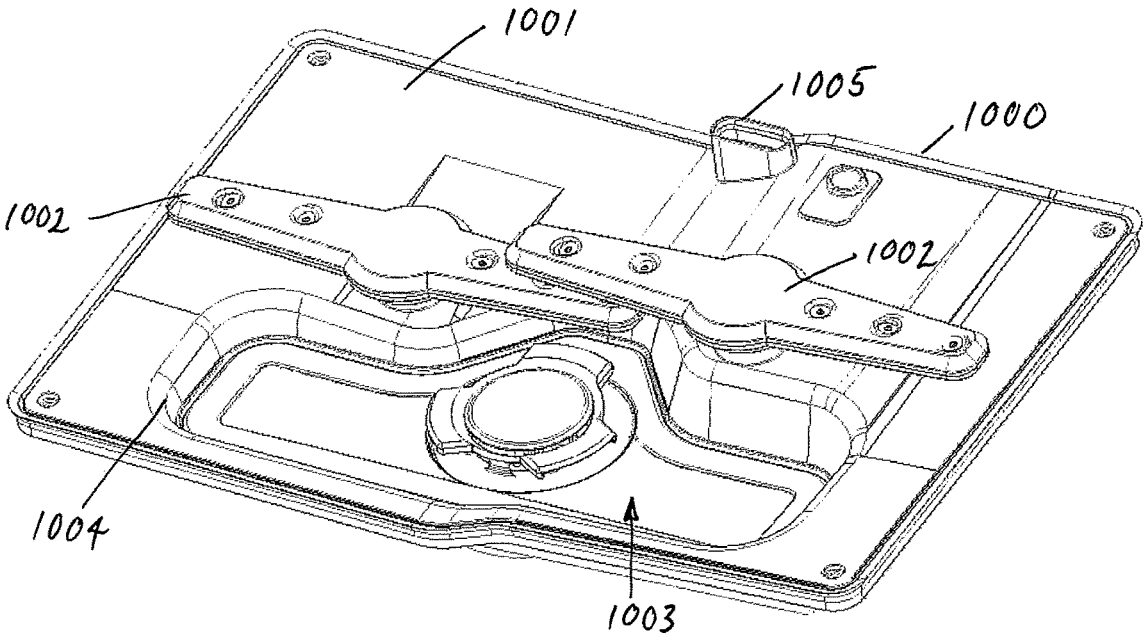
FIG. 10 is a perspective view of the pump cap assembly, which is inserted above the tub base as shown in FIG. 9, with spray arms and filtration system also shown.

An exemplary pump cap component 1000 for dishwasher 800 is shown in FIG. 10. The upper side of pump cap component 1000 forms the visible (to the user) interior base 1001 of the dishwasher and is provided with at least one, preferably two, rotatable spray arms 1002. Pump cap component 1000 is fixed to wash tub 901, preferably by fasteners such as screws passing through openings, such as those shown in its four corners, and into corresponding openings in the upper surface of tub base 902.

In the case of two spray arms the arms 1002 are preferably overlapped laterally (horizontally) as shown and to avoid collision they are offset axially (vertically). The spray arms may rotate in the same direction or be contra-rotating. The spray arms 1002 may be substantially hollow and designed to rotate in response to a substantially upwardly-directed flow of washing liquid into their hollow central hubs. The spray arms 1002 may be located on the pump cap component 1000 by pumped wash liquid outlet nozzle projections 1301 (see FIG. 13) formed in the upper surface of the pump cap component. Each nozzle projection 1301 is, in use, adapted to be located within a hollow central hub of a removable spray arm and is preferably provided with a blanked upper surface and radially-directed outlet orifices. A substantially annular bearing face may be provided about nozzle projections 1301 on the upper surface of the pump cap component 1000 to provide a low friction contact surface for the rim of the central hub on the underside of the spray arms. Removable racking (not shown) is preferably provided within the wash tub for supporting dishes/utensils above the spray arm(s) in such a way that rotation of the spray arm(s) is not hindered.

The vertical offset of the spray arms may be provided by an annular spacer beneath one of the spray arms or, as is shown in FIG. 10, by forming or moulding the upper surface of the pump cap component to include a raised section on which only one of the nozzle projections is provided. The raised section may be connected to a lower section by a ramp region, as shown in FIG. 10. It may also be seen in FIG. 10 that a filtration system 1003 is positioned in a recessed region 1004 of the pump cap component, the recessed region located over sump region 904 of the tub base in use. Filtration system 1003 preferably includes a substantially planar coarse filter plate surrounding a fine cylindrical fine mesh filter which itself surrounds a drain filter, very similar to that previously described and shown in FIG. 4. In addition to nozzle outlets 1301, pump cap component 1000 also preferably includes a further wash liquid outlet 1005 which may provide pumped, filtered washing liquid to a vertically extending conduit (not shown) at or near a rear wall of the wash tub which supplies a nozzle for directing washing liquid at the washing load from a position at or near the top of the wash space in the wash tub.

As mentioned above, preferably two spray arms are provided in dishwasher 800. In this way, improved coverage of the substantially rectangular "footprint" or base shape may be obtained compared to a single rotating spray arm which may not provide sufficient wash liquid spray to items of the wash load positioned near the shorter, furthest spaced sides of the wash tub base. In this situation, when a single wash pump is provided, it is necessary to distribute filtered and pumped wash liquid to two separate spray heads (and optionally, the further wash liquid outlet 1005). This could be achieved by the incorporation of additional ducting immediately below the spray arms and above the pump cap component, but this would:

- increase part count (not only because of the need for the additional ducts themselves but also the additional fasteners required to fix the ducting about the wash pump impeller and fix the ducting to the base) thereby increasing cost,
- reduce the visual appeal of the visible inner base of the appliance because the ducting would be visible to the user above the pump cap component, and provide "soil traps" which detrimentally capture and retain soil from the wash liquid without allowing it to enter the filtration system.

In contrast to the earlier embodiment, the pump cap component 1001 of this further embodiment is preferably formed as a pump cap assembly. That is, pump cap assembly component 1000 is made of at least upper and lower parts fixed together, preferably bonded or permanently welded together, wherein the facing surfaces of the two parts are spaced apart at least in a region or regions to form flow paths or chambers that are components of the wash system. As will become apparent, in contrast to the previous embodiment and the system disclosed in WO9312706A where the wash pump casing or housing surrounding the wash pump impeller is within the spray arm itself, a wash pump casing or housing 1102/1401 in the embodiment of FIGS. 8 to 14 is formed within the pump cap component assembly between its upper and lower parts. Wash pump housing outlet conduits are also formed in the assembly to channel the wash liquid from the wash pump housing to the nozzle projection(s) 1301 for the spray arm(s) and/or further wash liquid outlet 1005.

Figure 11:
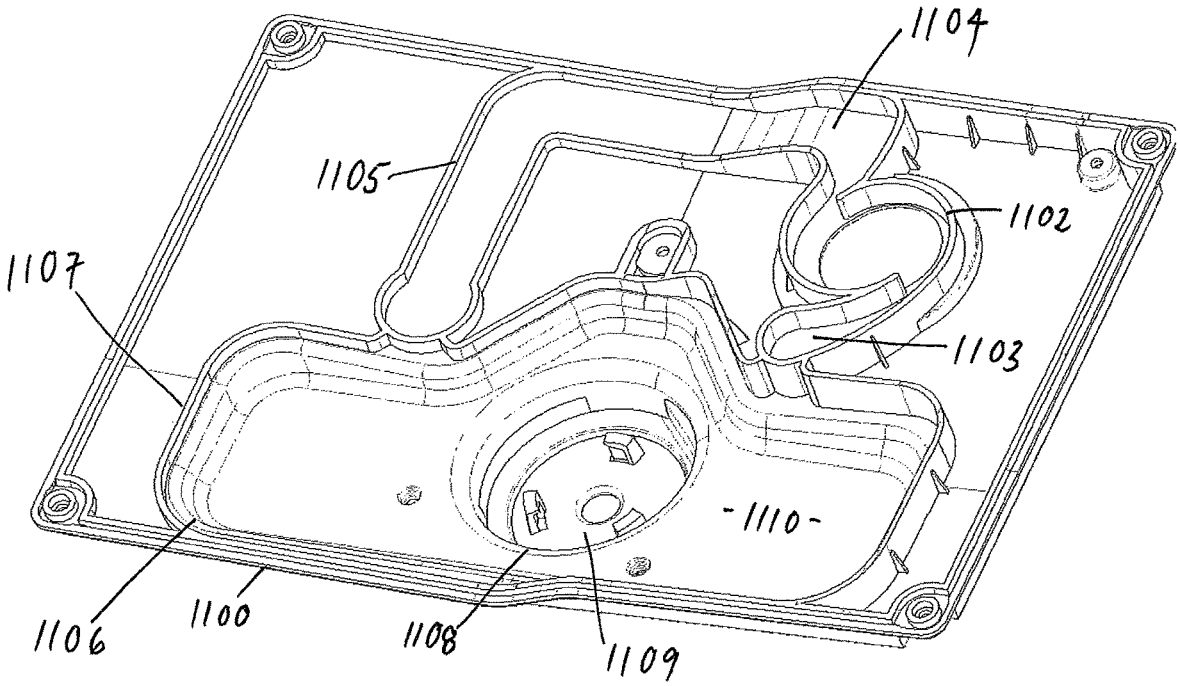
FIG. 11 is a perspective view of the upper side of the lower part of the pump cap assembly shown in FIG. 10.
Figure 12:
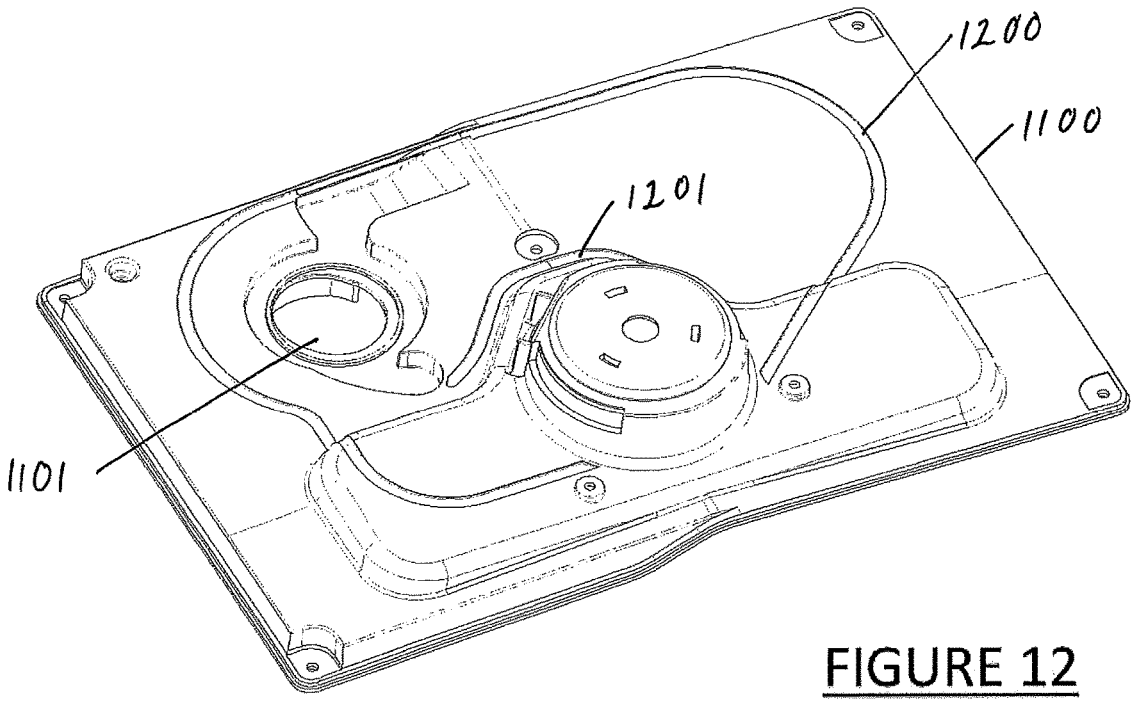
FIG. 12 is a perspective view of the underside of the lower part of the pump cap assembly shown in FIG. 11.
Figure 13:
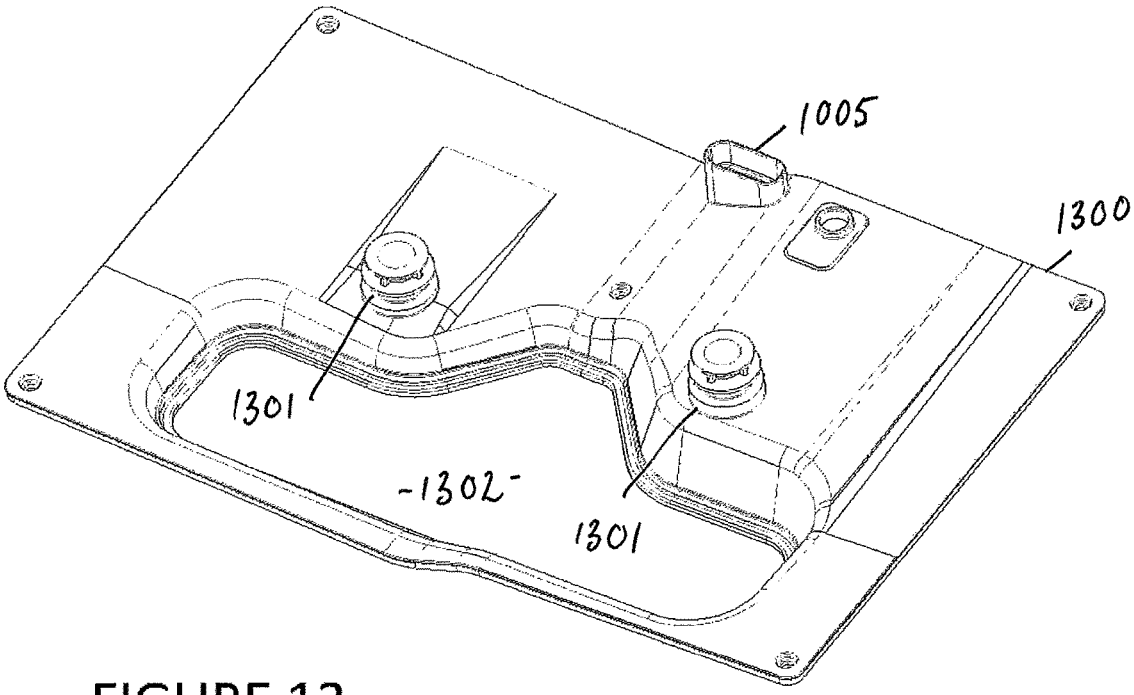
FIG. 13 is a perspective view of the upper side of the upper part of the pump cap assembly shown in FIG. 10.
Figure 14:
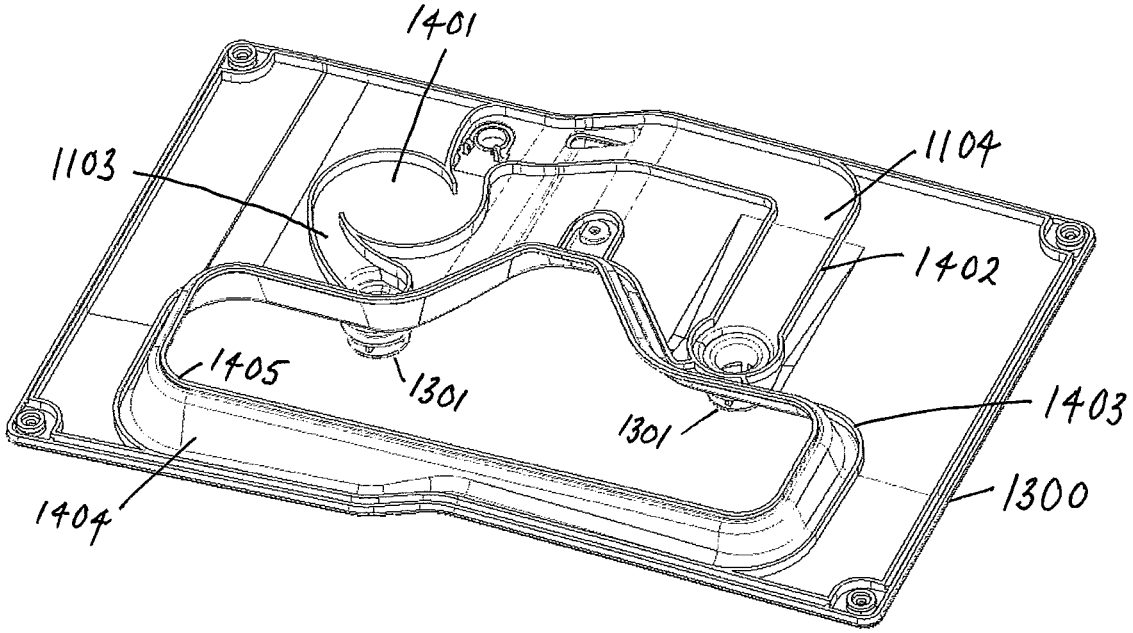
FIG. 14 is a perspective view of the underside of the upper part of the pump cap assembly shown in FIG. 13.

FIG. 11 is a view of the upper side of a first or lower part 1100 of the pump cap assembly 1000 whereas FIG. 12 is a view of the underside of the lower part 1100. FIG. 13 is a view of the upper side of a second or upper part 1300 of the pump cap assembly 1000 whereas FIG. 14 is a view of the underside of the upper part. Thus, it will be appreciated that FIGS. 10 and 13 are very similar. It will also be appreciated that the upper part 1300 as it is shown in FIG. 13 is positioned, in use, directly over and then bonded to the part as it is shown in FIG. 11 to arrive at the assembly component 1000 shown in FIG. 10.

As shown in FIGS. 11 and 12, the lower part 1100 of the pump cap assembly includes an opening 1101 to allow wash pump impeller 908 to be located within the pump housing 1102/1401 created when the upper and lower parts are connected. The opening 1101 is partially surrounded on upper part 1100 by a cylindrical wall 1102 with opposed breaks positioned in the wall to enable pumped washing liquid to laterally exit the pump housing and enter first 1103 and second 1104 wash pump housing outlet conduits. The side walls of conduits 1103 and 1104 are provided by raised ridges or ribs 1105 formed in or on the upper surface of the part 1100 with the side walls forming a closed shape which includes the cylindrical wall 1102 of the pump housing. As may be seen in FIG. 14, the underside of the upper part of the assembly has raised ridges or ribs 1402 in a corresponding closed-shape so that, when the upper and lower parts are in contact, the walls 1105 and 1402 are aligned and then bonded together so as to form a water-tight seal therebetween, the bonded walls forming the walls of the pump housing and of the pump housing outlet conduits formed thereby. As may be seen in FIG. 14, the downstream ends of the conduits 1103 and 1104 open upwardly into pumped wash liquid outlet nozzle projections 1301 while outlet 1005 may also be provided in the upper surface of conduit 1104 at a location along its length.

It will be appreciated from FIG. 11 that conduits 1103 and 1104, which are for channelling filtered washing liquid, are sealed off from a recessed region 1106. Recessed region 1106 which is itself surrounded by a raised wall 1107 which will bond to corresponding wall 1403 on the underside of upper part 1300 (see FIG. 14). Recessed region 1106 is adapted to be located, in use, over and partially within a recessed region of the tub base 902 which includes planar region 906, surrounding sump 904. Recessed region 1106 includes a substantially cylindrical depression 1108 which, in use, is positioned above and partially within sump region 904 of the tub base. Depression 1108 has a base 1109 with a central opening and/or the side wall of the depression also includes an opening or openings to enable a flow of filtered washing liquid downward, through the depression 1108 and into sump region 904. The base 1109 of depression 1108 is also provided with protruding hook members similar in shape and function to hook members 320 shown in FIG. 3 in relation to the first embodiment. Thus, filtration system 1103 may be removably attached to the lower part 1100 of the pump cap assembly via the hooks with the mesh filter located within depression 1108 and the coarse filter plate parallel to the planar region 1110 of recessed region 1106 which substantially surrounds depression 1108.

Of course, when the filtration system 1003 is attached to the lower part 1100, the upper part 1300 is already in place over the lower part so that a shaped opening 1302 (see FIG. 13) is located above and partially within recessed region 1106. The lower edge of a downwardly-directed skirt 1404 (forming recessed region 1004 in FIG. 10) around the periphery of shaped opening 1302 is adapted in use to abut against and form a sealed interface with the surface at or near the periphery of planar region 1110 on the upper surface of the lower part 1100 shown in FIG. 11. Alternatively, an additional sealing member could be provided around the periphery of shaped opening 1302. As a result, when the two parts of the pump cap assembly component are combined and the filtration system installed, as shown in FIG. 10, a sealing member around the periphery of the coarse filter plate seals against the inner surface of skirt 1404 (recessed region 1004). This seal, along with the seal around the perimeter of the pump cap assembly component 1001 ensures that any washing liquid below the pump cap assembly is "clean" (filtered) as it must have already passed through the filtration system and any washing liquid exiting recessed region 110 must do so via the sump.

As mentioned above, in common with the first embodiment, this further embodiment also includes substantially rectangular, elliptical or oblong (in transverse cross-section) wash liquid supply conduits providing liquid from the sump region 904 to the wash pump, providing the same benefits as previously discussed above in relation to the first embodiment. These low-height wash liquid supply conduits have a lower surface or wall provided by the upper surface of tub base 902 within the zone defined by elongated groove feature 909. The upper surface or wall of the low-height wash liquid supply conduits is provided by a zone of the underside of lower part 1100 of the pump cap assembly component (see FIG. 12), the perimeter of the zone being substantially described by a sealing member 1200 which may be an elastomeric sealing member over-moulded or co-moulded with lower part 1100.

Within the zone surrounded by sealing member 1200 is a further elongated sealing member 1201 which may also be an elastomeric sealing member over-moulded or co-moulded with lower part 1100. When the pump cap assembly component is installed above the wash tub base 902, elongated groove feature 909 and sealing member 1200 are aligned and in sealing contact to form first or laterally outer side walls of the low-height wash liquid supply conduits to the wash pump. Similarly, elongated groove feature 910 and sealing member 1201 are aligned and in sealing contact and thereby form opposed, second or laterally inner side walls of the low-height wash liquid supply conduits to the wash pump. Of course, the sealing members 1200 and/or 1201 could alternatively be provided on the upper surface of the wash tub base 902 and groove features 909 and/or 910 could be provided on the underside of pump cap assembly component 1000. Also, instead of groove features, ribs or ridges above the surrounding surface could alternatively be provided for sealing engagement with the sealing members. As shown by the arrows in FIG. 9, the thus-formed wash pump inlet supply conduits enable washing liquid to flow from opposed sides of the sump region 904 via two separate supply conduits, to the wash pump impeller with one of the conduits incorporating the heating element surface as part of, and substantially flush with, its lower surface or wall.

The invention claimed is:

1. A washing appliance comprising:

a washing tub for holding wash liquid and having a washing space therein adapted to receive items for washing, the washing tub having a base, a sump region in the base of the washing tub for collecting wash liquid, a wash pump having a wash liquid inlet in fluid connection with the sump region via a wash liquid conduit, and a wash liquid outlet in fluid connection with the washing space, and a heating unit positioned in the wash liquid conduit, wherein the shape of the wash liquid conduit, in transverse cross-section, is oblong along at least a portion of its length.

2. The washing appliance as claimed in claim 1, wherein the shape of the transverse cross-section of the wash liquid conduit includes perpendicular width and height dimensions, wherein one of the perpendicular dimensions is substantially greater than the other.

3. The washing appliance as claimed in claim 2, wherein the width is at least ten times greater than the height.

4. The washing appliance as claimed in claim 1, wherein the wash liquid conduit is generally "flat" or planar along the portion of its length, or the transverse cross-section is rectangular or elliptical in shape at least along the portion of its length.

5. The washing appliance as claimed in claim 1, wherein a surface of the base of the washing tub also forms at least a part of an internal wall of the wash liquid conduit.

6. The washing appliance as claimed in claim 5, wherein the sump region is in fluid connection with the wash liquid inlet of the wash pump via at least one wash liquid conduit and the sump region is provided with plural wash liquid outlets in fluid connection with the at least one wash liquid conduit.

7. The washing appliance as claimed in claim 5, wherein the internal wall of the wash liquid conduit is formed by the combination of a lower wall which is also a section of the base of the washing tub, directly opposite, spaced from and substantially parallel to an upper wall which is separate to the base with a seal therebetween.

8. The washing appliance as claimed in claim 1, wherein the base of the washing tub is inclined towards the sump region.

9. The washing appliance as claimed in claim 1, wherein the washing appliance is a drawer-style dishwasher or a table-top-style dishwasher.

10. The washing appliance as claimed in claim 1, wherein the sump region is in fluid connection with the wash liquid inlet of the wash pump via at least one wash liquid conduit and the sump region is provided with plural wash liquid outlets in fluid connection with the at least one wash liquid conduit.

11. The washing appliance as claimed in claim 10, wherein the wash pump and the sump region are in fluid connection via plural said wash liquid conduits, each of which is connected to a respective sump region wash liquid outlet.

12. The washing appliance as claimed in claim 11, wherein the sump region wash liquid outlets are circumferentially spaced about an axis of the sump region.

13. The washing appliance as claimed in claim 11, wherein a wash liquid filter having a cylindrical filtering surface is provided in the sump region, co-axial with an axis of the sump region.

14. The washing appliance as claimed in claim 1, wherein the heating unit is positioned so as to form part of, and is preferably substantially flush with, an internal wall of the wash liquid conduit.

15. The washing appliance as claimed in claim 14, wherein the transverse cross-sectional shape of the wash liquid conduit is substantially rectangular with two opposed substantially parallel sides that are longer than the distance therebetween, and wherein the heating unit includes a substantially flat heating plate that is located within an opening in one of the opposed substantially parallel sides so that the upper surface of the heating plate is substantially flush with the internal wall of the wash liquid conduit.

16. The washing appliance as claimed in claim 15, wherein the heating unit includes the substantially flat heating plate positioned in a region of the internal wall of the wash liquid conduit which is inclined with respect to a horizontal plane such that the heating plate has a region which is raised vertically with respect to other regions of the heating plate.

17. The washing appliance as claimed in claim 14, wherein the heating unit includes a substantially flat heating plate positioned in a region of the internal wall of the wash liquid conduit which is inclined with respect to a horizontal plane such that the heating plate has a region which is raised vertically with respect to other regions of the heating plate.

18. The washing appliance as claimed in claim 17, wherein the underside of the heating plate is provided with a temperature sensor in the vertically-raised region.

19. The washing appliance as claimed in claim 14, wherein the sump region is in fluid connection with the wash liquid inlet of the wash pump via at least one wash liquid conduit and the sump region is provided with plural wash liquid outlets in fluid connection with the at least one wash liquid conduit.

20. The washing appliance as claimed in claim 19, wherein the wash pump and the sump region are in fluid connection via plural said wash liquid conduits, each of which is connected to a respective sump region wash liquid outlet.

* * * * *